US006287152B1

(12) United States Patent
Yang

(10) Patent No.: US 6,287,152 B1
(45) Date of Patent: Sep. 11, 2001

(54) ROTATABLE SOCKET FOR A HALOGEN LAMP

(75) Inventor: Wen Ho Yang, Taipei Hsien (TW)

(73) Assignee: Sun Lite Sockets Industry Inc., Taoyuan Hsien (TW)

( * ) Notice: Subject to any disclaimer, the term of this patent is extended or adjusted under 35 U.S.C. 154(b) by 0 days.

(21) Appl. No.: 09/726,323

(22) Filed: Dec. 1, 2000

(51) Int. Cl.[7] ..... H01R 25/00
(52) U.S. Cl. ..... 439/644
(58) Field of Search ..... 439/337, 644, 439/673, 674

(56) References Cited

U.S. PATENT DOCUMENTS 1,922,394 * 8/1933 Raney ..... 439/673
2,054,497 * 9/1936 Doherty ..... 439/644
3,023,394 * 2/1962 Hubbell ..... 439/674
4,199,207 * 4/1980 Lee ..... 439/674
5,234,355 * 8/1993 Sosinski et al. ..... 439/337
5,417,594 * 5/1995 Herman et al. ..... 439/673

* cited by examiner

*Primary Examiner*—Brian Sircus
*Assistant Examiner*—Phuong K T Dinh
(74) *Attorney, Agent, or Firm*—Bacon & Thomas

(57) ABSTRACT

A rotatable socket for a halogen-lamp. The socket includes a porcelain base having two insert grooves at its bottom and an H-shaped upright post standing on the bottom. A plus and minus contact members respectively positioned in two opposite recessed sides of the H-shaped upright post. The top end of the plus contact member rests on a protruding lug on the top center of the H-shaped upright post. The top end of the minus contact member rests on the top of the right side wing of the H-shaped post. A mica plate is fitted on the H-shaped post and a metal threaded sleeve surrounds the H-shaped post and is fixed with it by rivets, permitting the top end of the plus contact member to protrude out in order to function as a plus terminal and an upper rim of the threaded sleeve presses the top section of the minus contact member to function as a minus terminal.

3 Claims, 8 Drawing Sheets

ROTATABLE SOCKET FOR A HALOGEN LAMP

BACKGROUND OF THE INVENTION

1. Field of the Invention

This invention relates to a rotatable holder for a halogen lamp, particularly to one that can be threadably connected with a conventional threaded lamp socket to fit a halogen lamp in order to increase its effectiveness and practicability, as well as ease of usage.

2. Description of the Related Art

A halogen lamp is quite different from the prior art threaded lamp. A halogen lamp is shown in FIG. 1. The top of the bulb 101 of the halogen-lamp 10 is provided with a connector 102 having upwardly protruding plus and minus insert lugs 103A, 103B and the lamp 10 is insertable into a lamp socket 20, which includes a cylindrical porcelain shell 201 having two arc-shaped insert grooves 202 for receiving the two insert lugs 103A, 103B of the lamp 10 and to engage therein by turning the lamp 10, to complete the combination of the halogen lamp 10 with the lamp socket 20, as shown in FIG. 3.

More specifically, the cylindrical porcelain shell 201 of the lamp socket 20, as shown in FIG. 4, is provided with two insert grooves 202 and two metal terminals 204 are positioned at outer sides of the two insert grooves 202 and connected with electric wires 203. Two spring members 205 are respectively provided in the insert grooves 202 and elastically contact the metal terminals 204 to push the terminals 204 to face the insert grooves 202. Then, an insulating disc 206 and a connecting frame 207 on the insulating disc 206 are combined with the upper end of the cylindrical porcelain shell 201 by means of rivets 207A. Then, the halogen-lamp 10 is inserted in the lamp socket 20, so that the insert lugs 103 of the halogen lamp 10 and the metal terminals 204 of the lamp socket 20 contact each other to make an electric connection for lighting. In addition, the elasticity of the spring members 205 pushes the metal terminals 204 to tightly clasp the insert lugs 103A, 103B of the halogen lamp 10 to maintain a smooth flow of electric current.

As can be understood from the description above, a special lamp socket 20 is needed for installing a halogen lamp 10. Conventionally, common threaded lamp sockets are installed on a wall and electric wires are hidden inside the walls to maintain an orderly appearance. When a halogen lamp is to be used, the hidden wires have to be found and pulled out to connect with a special lamp socket after the conventional threaded lamp socket has been removed, which is very complicated and inconvenient.

SUMMARY OF THE INVENTION

The objective of the invention is to offer a rotatable socket for a halogen lamp that can be threadably combined with a conventional lamp socket to fit a halogen lamp, taking advantage of widely available conventional common lamp sockets.

The rotatable socket for a halogen lamp in the present invention includes a porcelain base having two arc-shaped insert grooves in its bottom and an H-shaped upright post upwardly protruding on the bottom and having a protruding lug on the top center. Two coil springs are positioned at two opposite sides of the post, and plus and minus contact members are positioned in each of the two opposite sides. An upper curved section of the plus contact member rests on the protruding lug of the H-shaped post, and an upper curved section of the minus contact member is positioned on top of the right side wing of the H-shaped post. In addition, the lower ends of the two contact members are formed into terminals respectively extending to the insert grooves of the porcelain base to be positioned oppositely and in parallel. Two coil springs are then separately positioned between the backside of each terminal member and the porcelain base to push the terminal members to bias on to the outer circumference of the inserting grooves.

A mica plate is then placed on the H-shaped post, which is surrounded by a metal threaded sleeve by means of rivets. The metal threaded sleeve presses both the mica plate and the plus and the minus contact members in place. The metal threaded sleeve includes an open top for the upper curved section of the plus contact member to protrude out, and a top annular rim protrudes inwardly to press the top curved section of the minus contact member on the right side wing of the H-shaped post. Thus the rotatable socket for a halogen-lamp is completed.

In connecting the rotatable socket for a halogen lamp with a conventional lamp socket, the threaded rotatable sleeve is threadably combined with the female threaded metal cylinder of the conventional lamp socket to let the plus and minus contact members and the rotatable sleeve to respectively and correspondingly contact with the plus connect point and the minus threaded cylinder of the conventional lamp socket. At the same time, the inserting lugs of the halogen lamp are inserted into the insert grooves at the bottom of the porcelain base to contact with the plus and minus terminal members.

BRIEF DESCRIPTION OF DRAWINGS

This invention will be better understood by referring to the accompanying drawings, wherein.

DETAILED DESCRIPTION OF A PREFERRED EMBODIMENT

Figure 1:
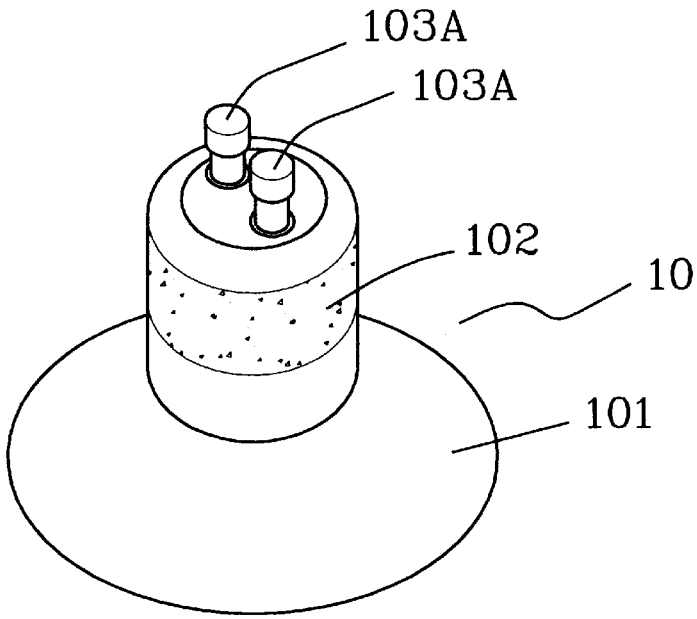
FIG. 1 (PRIOR ART)
FIG. 1 is a perspective view of a conventional halogen lamp.
Figure 2:
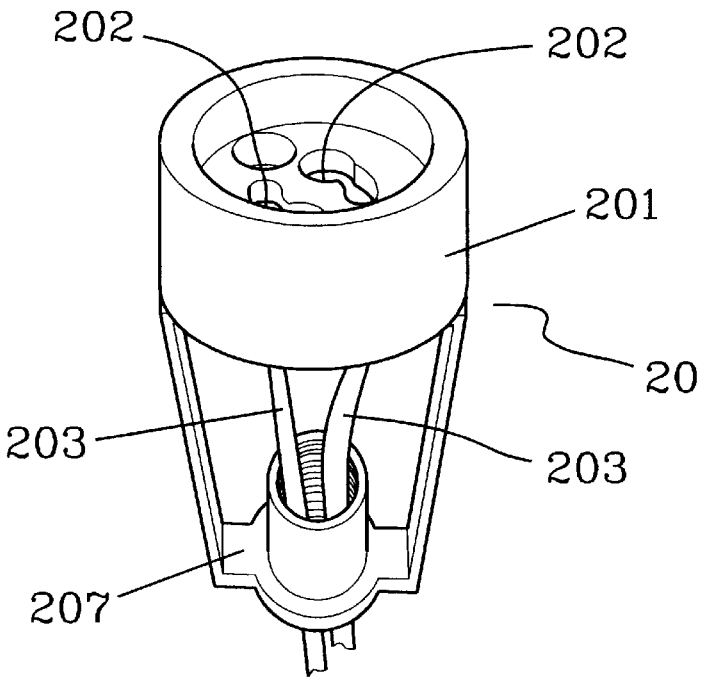
FIG. 2 (PRIOR ART)
FIG. 2 is a perspective view of a conventional halogen lamp socket.
Figure 3:
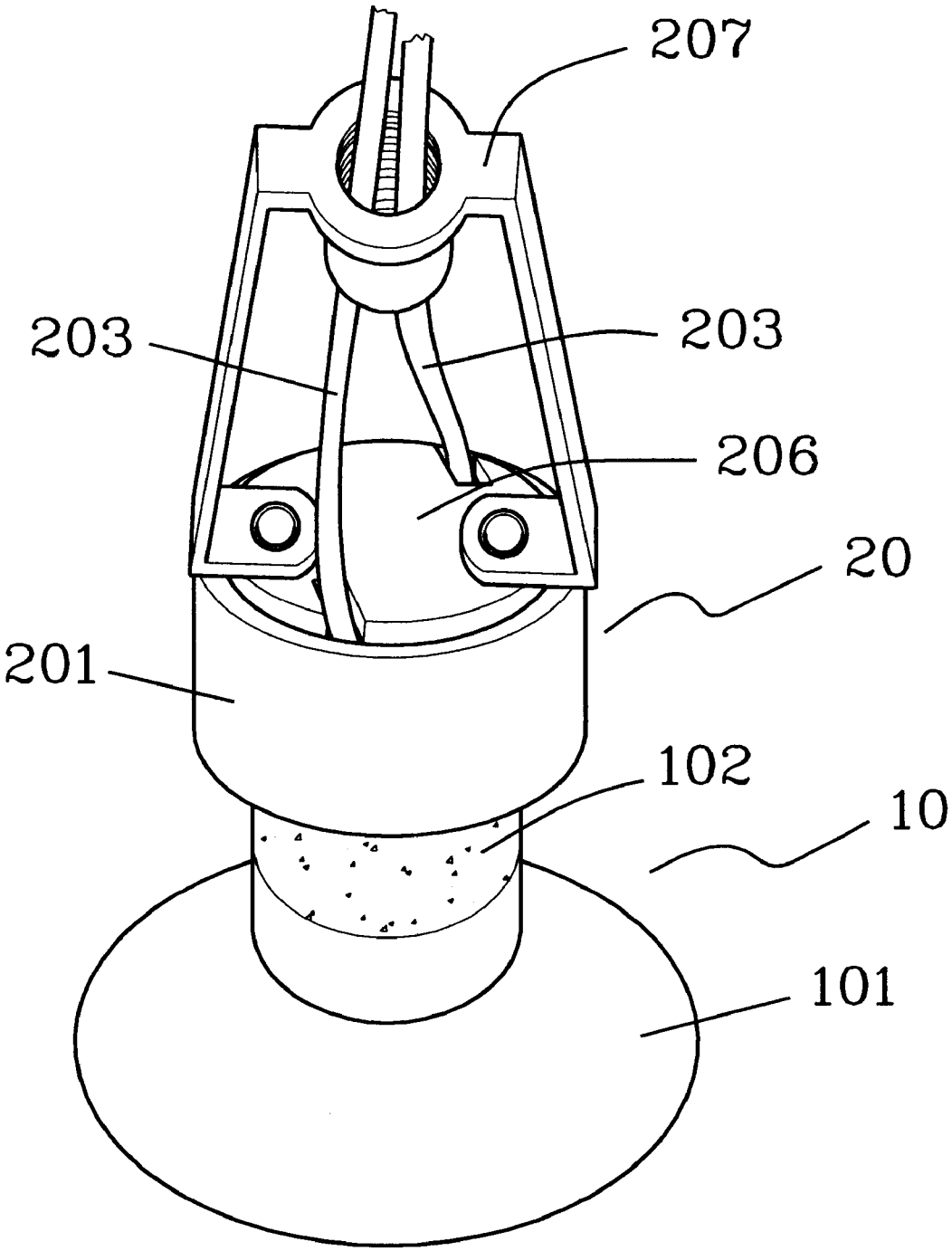
FIG. 3 (PRIOR ART)
FIG. 3 is a perspective view of the conventional halogen lamp of FIG. 1 combined with the conventional halogen lamp socket of FIG. 2.
Figure 4:
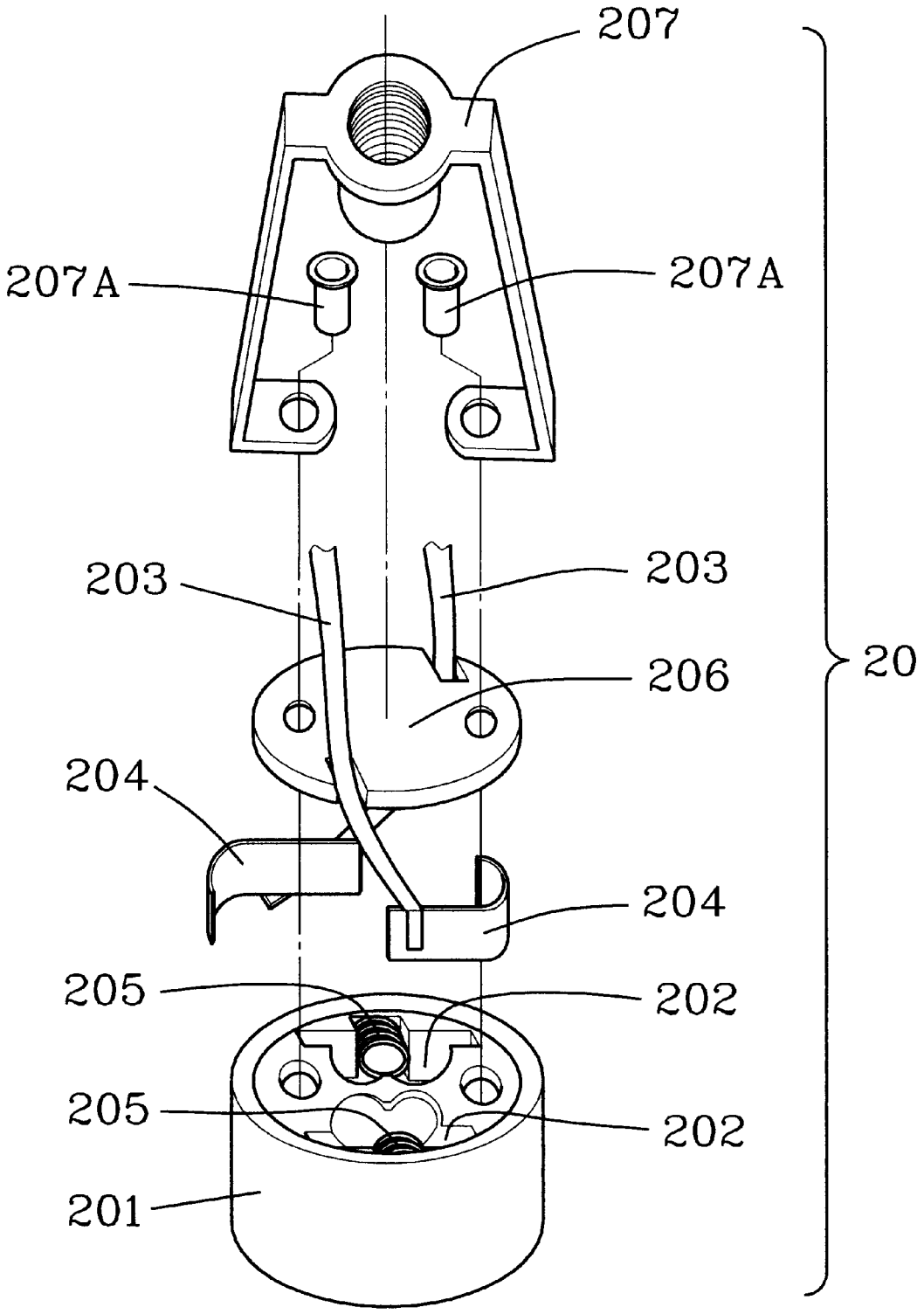
FIG. 4 (PRIOR ART)
FIG. 4 is an exploded perspective view of the conventional halogen lamp socket.
Figure 5:
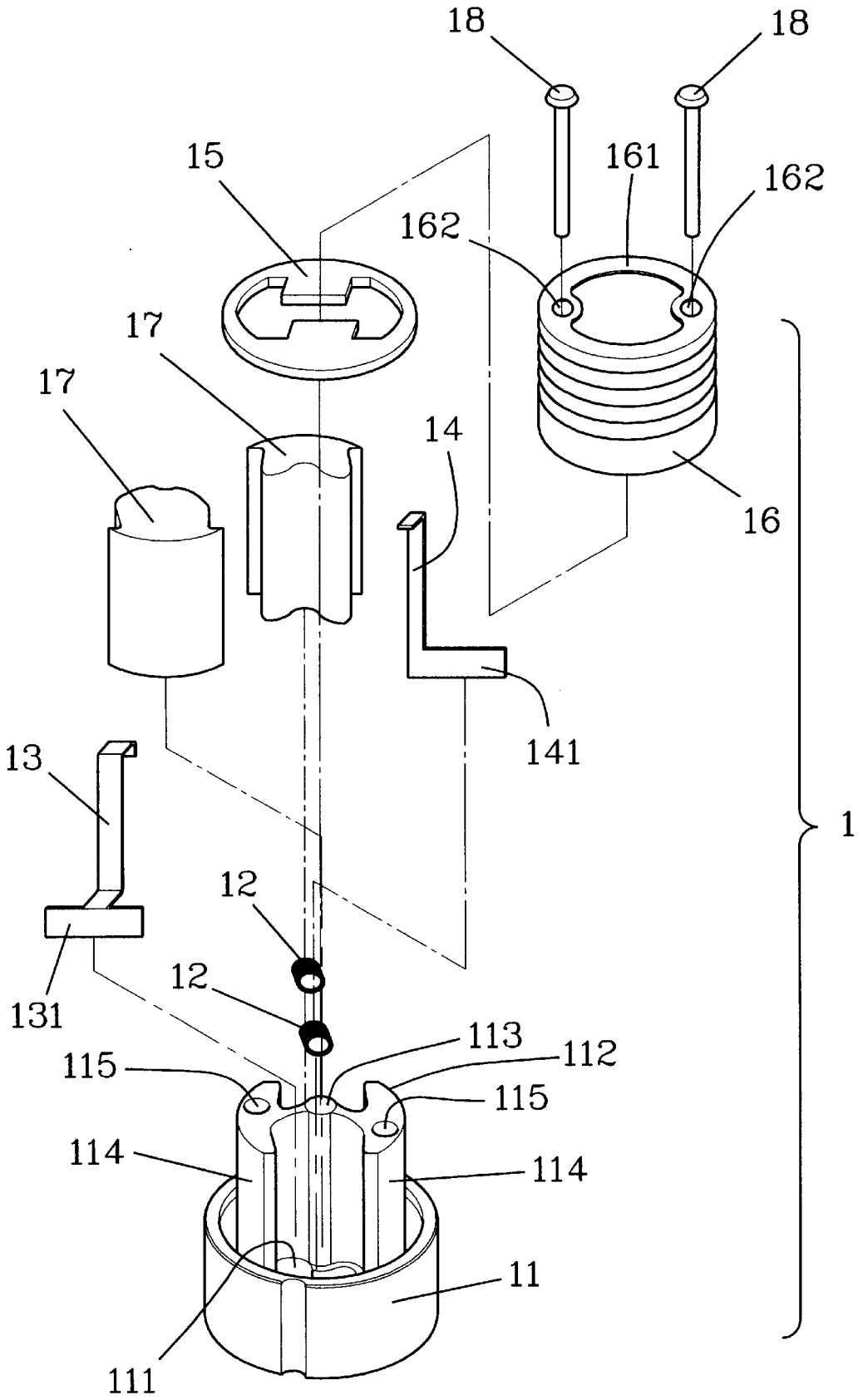
FIG. 5 is an exploded perspective view of a rotatable socket for a halogen lamp of the present invention.
Figure 6:
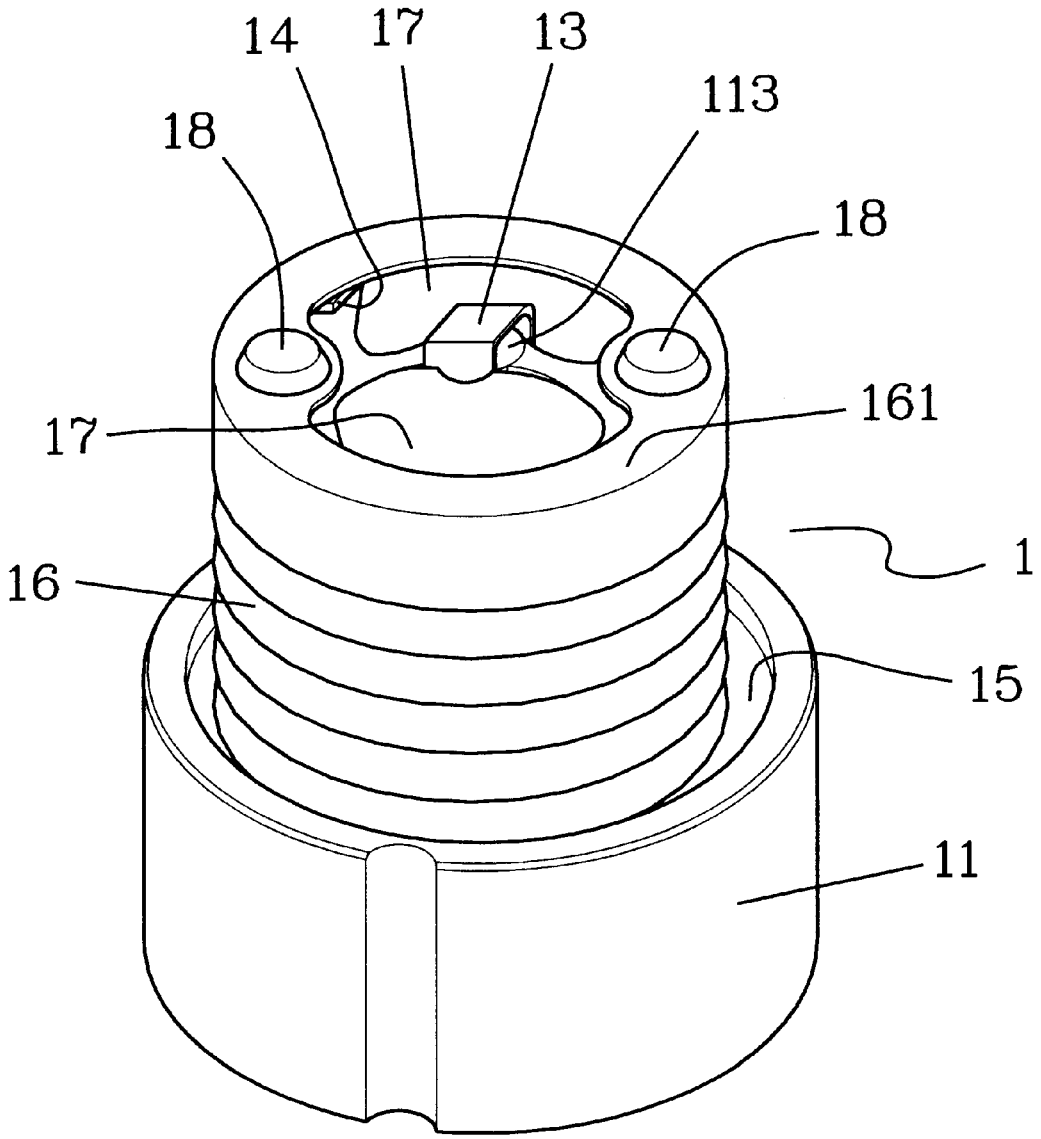
FIG. 6 is a perspective view of the rotatable socket for a halogen lamp of the present invention.

The inventive rotatable socket 1 for a halogen lamp, as shown in FIG. 5, includes a porcelain base 11, a mica plate 15, a threaded rotatable sleeve 16 and two porcelain blocks 17 as main components that are assembled together.

Figure 7:
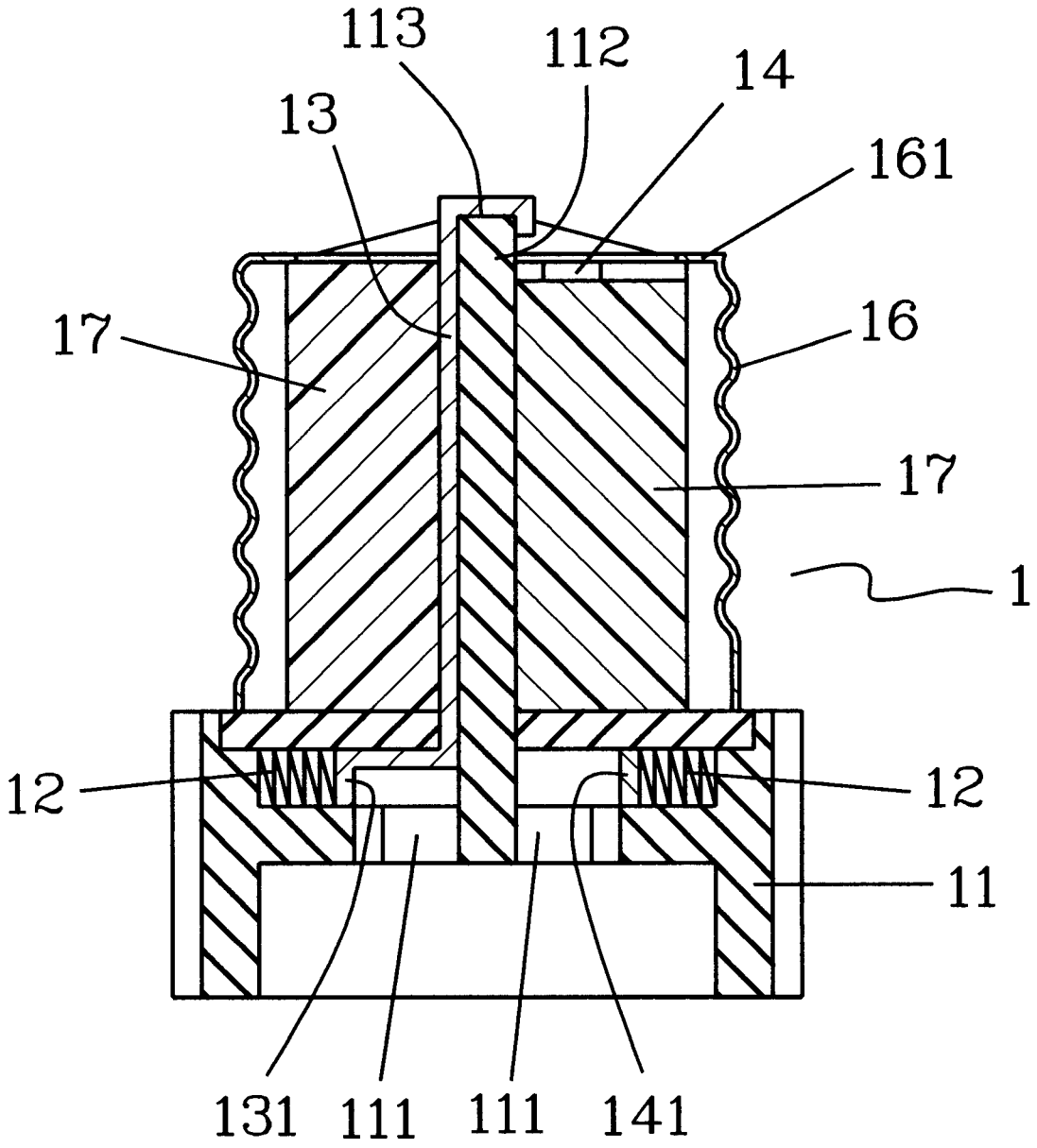
FIG. 7 is a cross-sectional view of the rotatable socket for a halogen lamp in the present invention.
Figure 8:
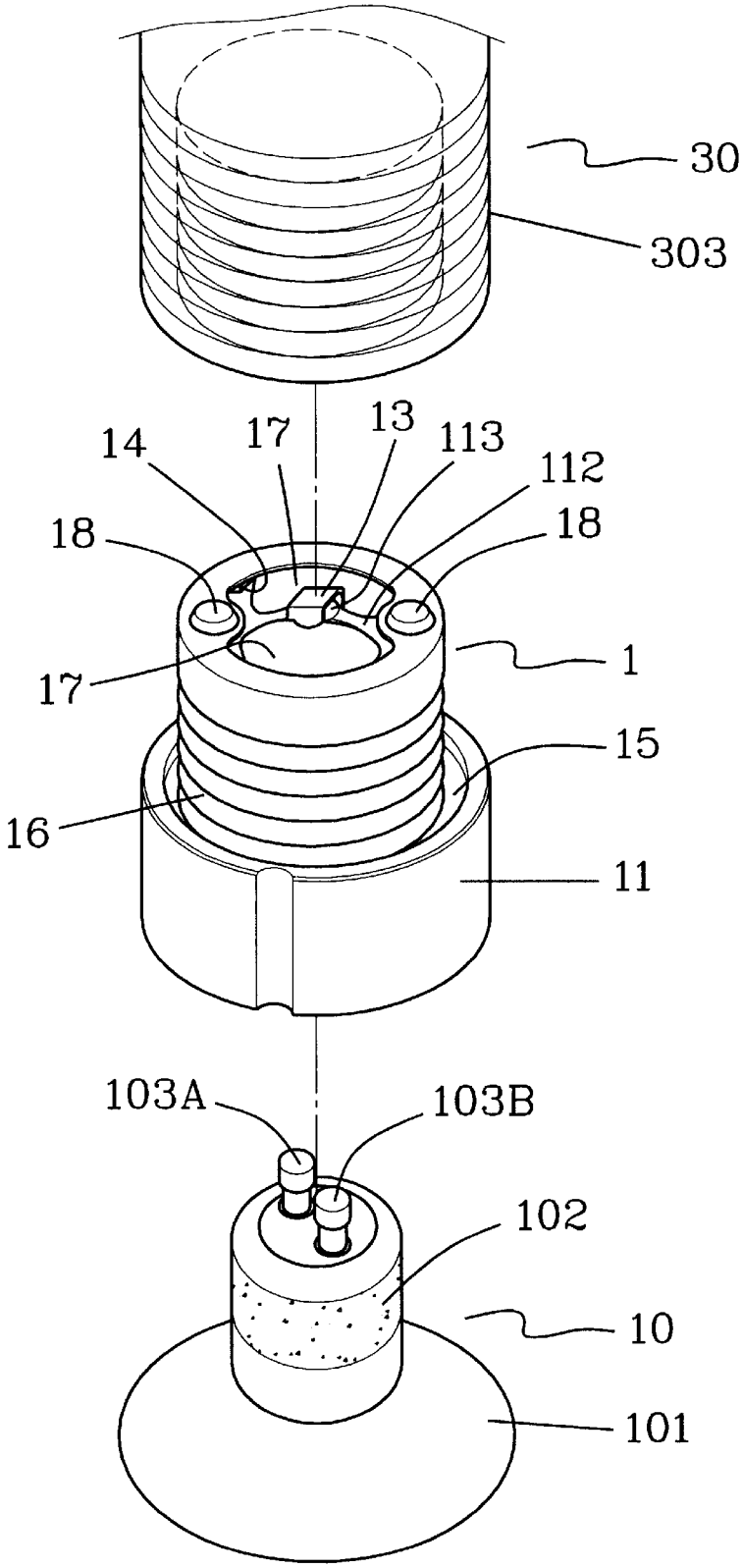
FIG. 8 is an exploded view of the conventional lamp socket, the rotatable socket for a halogen lamp of the present invention, as well as a conventional halogen lamp.

The porcelain base 11 has two arc-shaped insert grooves 111 in its bottom, as shown in FIG. 7, and a H-shaped upright post 112, as shown in FIGS. 5 and 8, formed to stand on the bottom of the base 11 and having two side wings 114, a projecting lug 113 formed on a top center thereof and a vertical through hole 115 bored respectively in each side wing 114.

Then, two coil springs 12 and a plus contact member 13 and a minus contact member 14 are respectively provided in each of the two opposite recessed sides of the H-shaped upright post 112, and the plus and the minus contact members 13, 14 extend to the insert grooves 111 of the porcelain base 11 to let their lower terminals 131, 141 to be positioned therein opposite and parallel with each other.

The mica plate 15 is fitted on the H-shaped post 112 which is surrounded by a metal threaded rotatable sleeve 16 having an open top and an inward protruding annular press rim 161 bored with two insert holes 162 corresponding to the insert holes 115 of the two side wings 114 of the H-shaped upright post 112. Further, the two porcelain blocks 17 are contained in the two opposite recessed sides of the upright post 112.

Upon assembly, the two coil springs 12 and the plus and the minus contact members 13, 14 are respectively positioned in each of the two opposite recessed sides of the H-shaped upright post 112. Then an upper curved section of the plus contact member 13 rests on top of the projecting lug 113 on the top center of the H-shaped upright post 112, while an upper curved section of the minus contact member 14 is positioned on top of the right side wing 114. Then, the terminals 131, 141 of the contact members 13, 14 are respectively positioned in each of the two insert grooves 111 of the porcelain base 11, and the coil springs 12 are respectively placed between the backsides of the terminals 131, 141 and the porcelain base 11 to push the terminals 131, 141 to always be biased onto the outer circumferential walls of the insert grooves 111.

Further, the mica plate 15 is fitted on the H-shaped upright post 112, to press the upper sections of the terminals 131, 141 and the coil springs 12, and then the threaded rotatable sleeve 16 is placed around the H-shaped upright post 112 and fixed to the base 11 by rivets 18 that pass through the insert holes 162 of the press rim 161 of the threaded rotatable sleeve 16 and the insert holes 115 of the two side wings 114, with the bottom of the rivets 18 pressing the mica plate 15, as well as the plus and the minus contact members 13, 14 in place. In addition, the top curved section of the plus contact member 13 extends out of the open top of the threaded rotatable sleeve 16 to rest on the projecting lug 113 of the H-shaped upright post 112, while the top curved section of the minus contact member 14 is positioned on the top of the right side wing 114 of the H-shaped upright post 112 and pressed by the press rim 161 of the threaded rotatable sleeve 16, and lastly, two porcelain blocks 17 respectively fill-up each gap formed between the H-shaped upright post 112 and the inner wall of the threaded rotatable sleeve 16 to complete the assembly of the threaded rotatable socket 1.

In accordance with the above mentioned rotatable socket 1, the top end of the plus contact member 13 functions as a plus terminal of the threaded rotatable socket 1, with the threaded rotatable sleeve 16 contacting with the minus contact member 14 and functioning as a minus terminal of the threaded rotatable socket 1. Further, the mica plate 15 presses the upper sections of the terminal members 131, 141 to function as an insulator that separates the plus contact member 13 from the threaded rotatable sleeve 16 to prevent short-circuits, and the porcelain blocks 17 filling up the gaps between both the opposite recessed sides of the H-shaped post 112 and the threaded sleeve 16 to function as an insulator as well.

Figure 9:
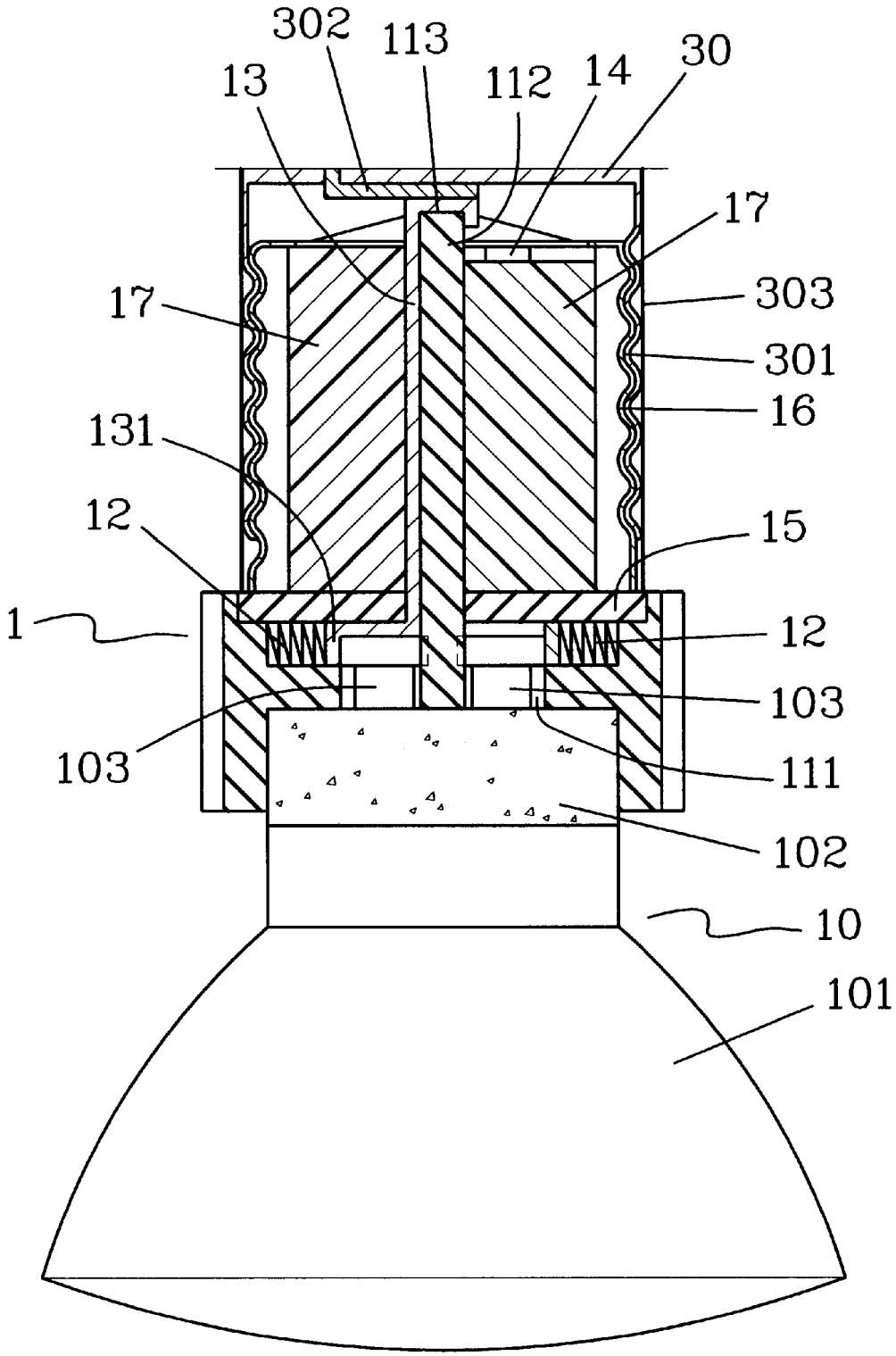
FIG. 9 is a cross-sectional view of the inventive rotatable socket for a halogen lamp assembled with a conventional threaded lamp socket and a conventional halogen lamp.

When a halogen lamp 10 is to be assembled with a conventional threaded lamp socket 30, a simple method is to threadably connect the threaded rotatable socket 1 of this invention with the conventional threaded lamp socket 30, as shown in FIGS. 8 and 9, by engaging the threaded rotatable sleeve 16 of the threaded rotatable socket 1 with the metal threaded rotatable cylinder 301 of the conventional threaded lamp socket 30 to let the top end of the plus contact member 13 protruding out of the threaded rotatable sleeve 16 to contact with the plus contact point 302 on an inner top of the threaded cylinder 301, and the minus threaded rotatable sleeve 16 contacts with the minus threaded cylinder 301 protected by an insulating shell 303, and simultaneously the inserting lugs 103A, 103B of the halogen lamp 10 are inserted in the insert grooves 111 at the bottom of the porcelain base 11 and turned tightly to contact the plus and the minus contact members 131, 141 to complete the electric connection for the halogen-lamp 10.

In summary, the rotatable socket 1 can be threadably connected to a conventional threaded lamp socket 30 in order to receive the halogen-lamp 10 without any need for a special lamp socket or removing of the conventional threaded lamp socket 30, in other words, a halogen lamp can be adapted to a conventional threaded lamp socket 30 or removed from it, enhancing the usefulness of the conventional threaded lamp socket.

While the preferred embodiment of the invention has been described above, it will be recognized and understood that various modifications may be made therein, and the appended claims are intended to cover all such modifications that may fall within the spirit and scope of the invention.

What is claimed is:

1. A rotatable socket for a halogen lamp comprising:

a porcelain base comprising two arc-shaped insert grooves in its bottom, an H-shaped upright post formed to stand on said bottom, the H-shaped upright post comprising two oppositely positioned left and right side wings, two coil springs positioned at two opposite recessed sides of said upright post, a plus contact member and a minus contact member respectively positioned in said two recessed sides of said H-shaped upright post, a top curved section of said plus contact member resting on a top center of said H-shaped upright post, a top curved section of said minus contact member positioned on top of said right side wing of said H-shaped upright post, said plus and minus contact members extending to said insert grooves and forming terminal members positioned oppositely and in parallel with each other, said coil springs respectively positioned between backs of said terminal members and said porcelain base to push said terminal members to contact an inner circumference of said insert grooves, said H-shaped upright post fitted with a mica plate and surrounded by a metal threaded rotatable sleeve which is riveted together with said side wings of said H-shaped post, with its bottom rim pressing said mica plate as well as said plus and minus contact members, said threaded rotatable sleeve having an open top to permit a top section of said plus contact member to protrude out therefrom and an annular rim on its top to press said top section of said minus contact member on said right side wing of said H-shaped post, and said rotatable socket is rotatably attachable and electrically connectable to a conventional lamp socket such that a halogen lamp is securable on to the rotatable socket and electrically connectable thereto.

2. The rotatable socket for a halogen lamp as claimed in claim 1, wherein a projecting lug is formed integral on said top center of said H-shaped upright post to let the top curved section of said plus contact member rest on and protrude out of said threaded rotatable sleeve so that said plus contact member is contactable with a plus terminal of a conventional threaded lamp socket.

3. The rotatable socket for a halogen lamp as claimed in claim 1, wherein two gaps are formed between said two opposite sides of said H-shaped upright post and said threaded rotatable sleeve can be respectively filled up with porcelain blocks to insulate said upright post from said threaded rotatable sleeve.

* * * * *